US005326025A

United States Patent [19]

Dempsey et al.

[11] Patent Number: 5,326,025

[45] Date of Patent: Jul. 5, 1994

[54] WARM UP METHOD FOR TWO STAGE FURNACE

[75] Inventors: Daniel J. Dempsey, Carmel; Kevin D. Thompson, Indianapolis, both of Ind.

[73] Assignee: Carrier Corporation, Syracuse, N.Y.

[21] Appl. No.: 89,792

[22] Filed: Jul. 8, 1993

[51] Int. Cl.[5] ..... G05D 23/00

[52] U.S. Cl. ..... 236/11; 236/46 E; 236/DIG. 9

[58] Field of Search ..... 236/11, 10, 1 E, 1 EA, 236/1 EB, 46 E, DIG. 9; 165/12

[56] References Cited

U.S. PATENT DOCUMENTS

| | | | |
|---|---|---|---|
| 3,472,220 | 10/1969 | Willson | 126/110 |
| 3,912,162 | 10/1975 | Bauer | 236/11 |
| 4,122,999 | 10/1978 | Belcastro | 236/11 |
| 4,123,000 | 10/1978 | Miller | 236/11 |
| 4,356,962 | 11/1982 | Levine | 236/11 |
| 4,369,916 | 1/1983 | Abbey | 236/11 |
| 4,408,711 | 10/1983 | Levine | 236/11 |
| 4,773,586 | 9/1988 | Ryan | 236/11 |
| 4,815,524 | 3/1989 | Dempsey et al. | 236/46 E |
| 4,976,459 | 12/1990 | Lynch | 236/11 |
| 4,982,721 | 1/1991 | Lynch | 126/116 A |
| 5,011,073 | 4/1991 | Izaguorre, Sr. et al. | 236/11 |
| 5,027,789 | 7/1991 | Lynch | 126/116 A |

*Primary Examiner*—Harry B. Tanner

[57] ABSTRACT

A two-stage furnace is operable at a high fire full rate mode and at a low fire partial rate mode when there is a call for high heat or low heat, respectively. In order for the furnace to be less prone to vent gas condensate formation when operating at low fire, and to permit the heat exchanger and vent pipe to reach equilibrium as soon as possible on both low fire and high fire, a shorter blower-on delay is provided for high fire and longer blower-on delay is provided on low fire.

3 Claims, 2 Drawing Sheets

WARM UP METHOD FOR TWO STAGE FURNACE

BACKGROUND OF THE INVENTION

The present invention is directed to a furnace for providing heated circulation air to an interior comfort space, and is more particularly directed to a gas fired forced air furnace that can be operated at a full rate or high-heat mode and at a partial rate or low-heat mode.

Conventional forced air furnaces cycle on and off to maintain a desired temperature within a comfort space i.e., within a building interior.

A thermostat senses the temperature in the comfort zone relative to a predetermined set point temperature. When the temperature is below the set point, the thermostat closes to supply thermostat ac power to the furnace as a call for heat. This causes the furnace to come on, initiating an inducer motor to flow combustion air, after which a gas valve is actuated to supply gas to the gas burners. An ignition device is also actuated to light the burners. A flame sensor then proves burner ignition and sends power to a burner delay timer. Then after a predetermined blower on delay time, which varies with furnace design, the furnace blower is actuated. The blower moves circulating room air from a return air duct through the furnace heat exchanger to pick up heat from the heated combustion products (carbon dioxide and water vapor) from the gas burners. The heated circulation air then goes into a hot air plenum and is distributed through hot air ductwork back to the comfort space. When the comfort space air is warmed sufficient to reach the thermostat set point, the thermostat terminates the call for heat. When this happens the blower and burners go through a shut off sequence and the furnace awaits the next call for heat.

The purpose of the blower time delay is to give the burners and the heat exchanger sufficient warm up time before blower actuation. This ensures that the furnace does not blow recirculating cold air back into the comfort space after a call for heat. Also, this blower-on delay allows the heat exchanger and vent gas temperatures to rise to optimal operating levels before return air is circulated. This limits the amount of condensation in the heat exchanger and in the vent or exhaust pipe during the early phase of a heating cycle.

In a modern two-stage furnace, the gas burners can be actuated at a full flow rate or high-fire mode or at a reduced rate or low fire mode, depending on the heating requirement for the comfort space. In cold weather when the heating load is great, high fire is selected, and in moderate weather when a lesser heating load is imposed low fire is selected. This can be done internally by the furnace control circuitry, based, for example, on the cycle time for the previous heating cycle.

In a conventional scheme for a two stage furnace the same blower on delay time is used for both the high fire and low fire modes. This can unduly lengthen the warm up of the heat exchanger and exhaust vent, and an unacceptable amount of vent condensation can result when the furnace is operated at low fire.

OBJECTS AND SUMMARY OF THE INVENTION

It is an object of this invention to provide a two stage furnace that avoids the drawbacks of the prior art.

It is another object of this invention to allow furnace heat exchanger and vent temperatures to reach steady state conditions as quickly as possible under full or moderate heat conditions, and to minimize condensate dwell time.

According to an aspect of this invention, a forced air furnace is operative to select high heat or low heat modes, depending on heating conditions of the comfort space, and to actuate its burners into high fire or low fire, respectively, when there is a call for heat.

In high heat, after a flame sensor proves combustion, a blower time delay is commenced for a high-fire blower-on delay. This delay can be e.g. forty-five seconds. That is, in the high-fire mode the blower will come on forty-five seconds after burner flame is proven.

In low heat, after burner flame is proven the blower time delay is commenced for a low-fire blower-on delay which is longer than the high-fire delay. This delay can be, e.g., seventy-five seconds. Thus in the low-fire mode the blower will come on seventy-five seconds after the burner flame is proven.

This use of different burner-on delay times for high heat and low heat allows the vent gas to reach steady state quickly under either condition, and minimizes condensate dwell time under either condition. Also a shorter burner-on delay time is used for igniting on high fire so as to avoid nuisance actuation of safety temperature limit switches. In current two-stage furnaces, wherein the same blower-on delay is used for all burner speeds, the single delay time is either a compromise of those conditions or is the shorter high-fire blower-on delay time.

In furnaces where the burners can be run at more than two speeds, a similar number of burner-on delay times would be used.

The above and many other objects, features, and advantage of this invention will become apparent from the ensuing description of a preferred embodiment, which should be read in conjunction with the accompanying Drawing.

BRIEF DESCRIPTION OF A PREFERRED EMBODIMENT

DETAILED DESCRIPTION OF THE PREFERRED EMBODIMENT

Figure 1:
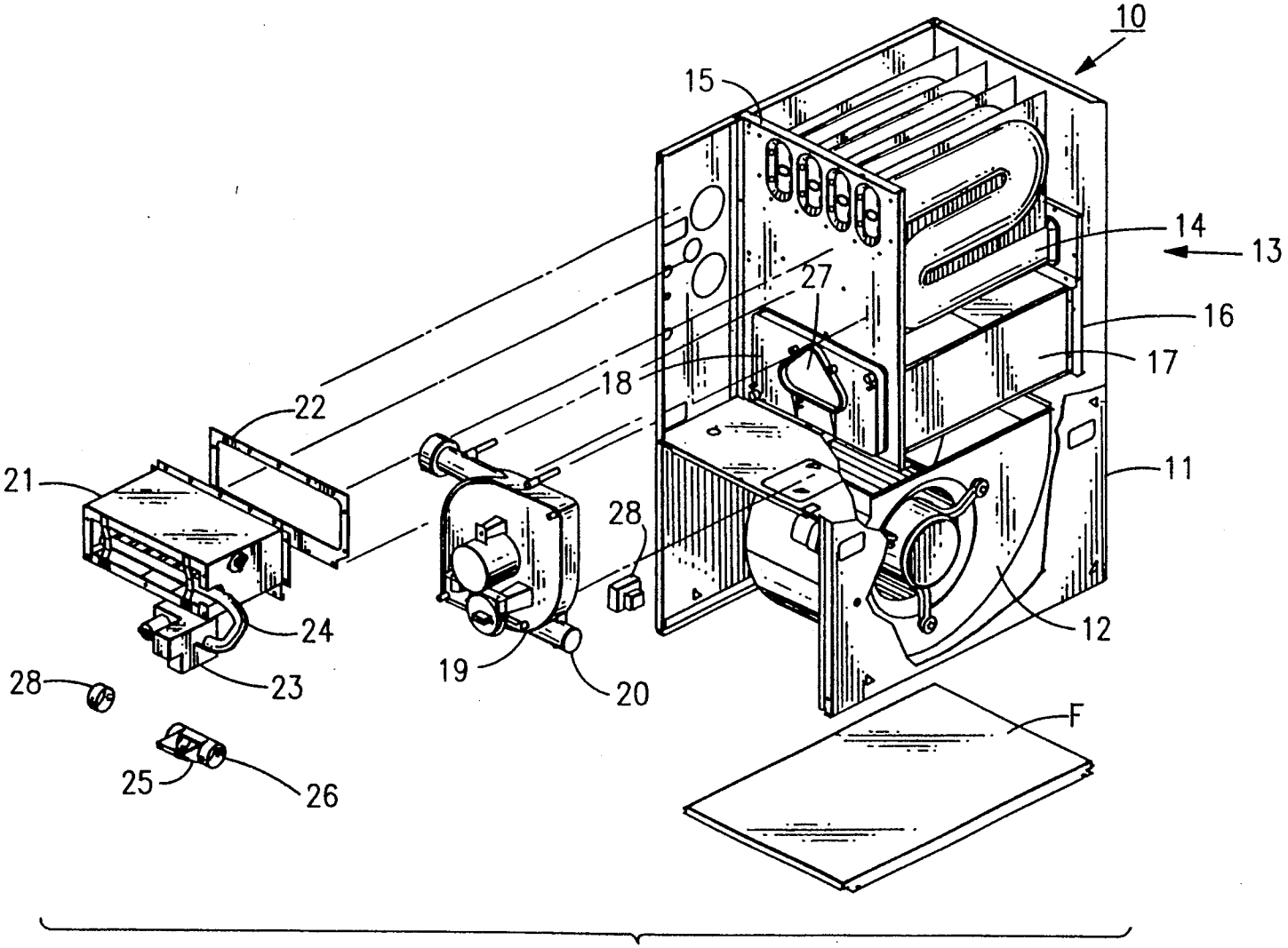
FIG. 1 is an assembly view, partly exploded, of a two-stage furnace according to an embodiment of this invention.

With reference initially to FIG. 1 of the Drawing, a furnace 10 is here configured in an upflow mode, although it could as easily be poised in a horizontal flow mode or in a down flow mode. A housing or cabinet 11 has a filter F at its base filtering return air received from a cold air plenum (not shown). The air is blown upwards by a circulation blower 12 through a two-stage heat exchanger 13. The heat exchanger has a three-pass primary stage 14, here shown with burner openings 15, followed by a connector box 16 and a secondary or condensing heat exchanger stage 17. The secondary heat exchanger stage discharges into a collector box 18 mounted on the front of the heat exchanger. The collector box 18 collects condensed water from the secondary stage and passes same to a not-shown trap and condensate drain. An inducer 19, i.e., a blower for inducing combustion air flow, is mounted on the collector box and blows gaseous combustion products through a vent outlet 20 thereof into an exhaust or vent pipe, which is not shown in this view.

A burner box 21 which houses the gas burners is mounted onto the front panel of the heat exchanger 13 and a gasket 22 provides an air-tight seal. A gas valve 23 supplies a burner manifold 24 with natural gas, propane or another suitable fuel gas received from a gas pipe (not shown). An air inlet 25 is mounted on one side of the burner box to furnish combustion air that it receives from a not-shown combustion air inlet pipe that connects to one end 26 of the air inlet 25. The inducer 19 is energized to exhaust combustion product gases through the vent pipe and thus induce an air flow through the inlet pipe and air inlet 25 into the burner box 21.

A control box 27, sketched in ghost, is positioned within the cabinet 11 and contains electrical and electronic components such as relays, delay timers, and a suitably programmed microprocessor to control operating of the furnace 10 in response to a thermostat located in the comfort space. A twenty-four volt thermostat transformer 28 is favorably located within the furnace cabinet 11 and has leads going to the thermostat as well as conductors supplying thermostat power to the control box 27. While not specifically shown here, the furnace 10 includes a flame sensor positioned on or within the burner box for proving ignition of the burners, and pressure switches on the burner box to prove adequate pressure of combustion air within the box 21 to support high-fire operation and low-fire operation, respectively.

In this embodiment, the heated circulation air that has passed through the heat exchanger 13 and absorbed the heat of the combustion products proceeds upwards to hot air plenum, from which it returns through suitable ductwork to the comfort space.

Figure 2:
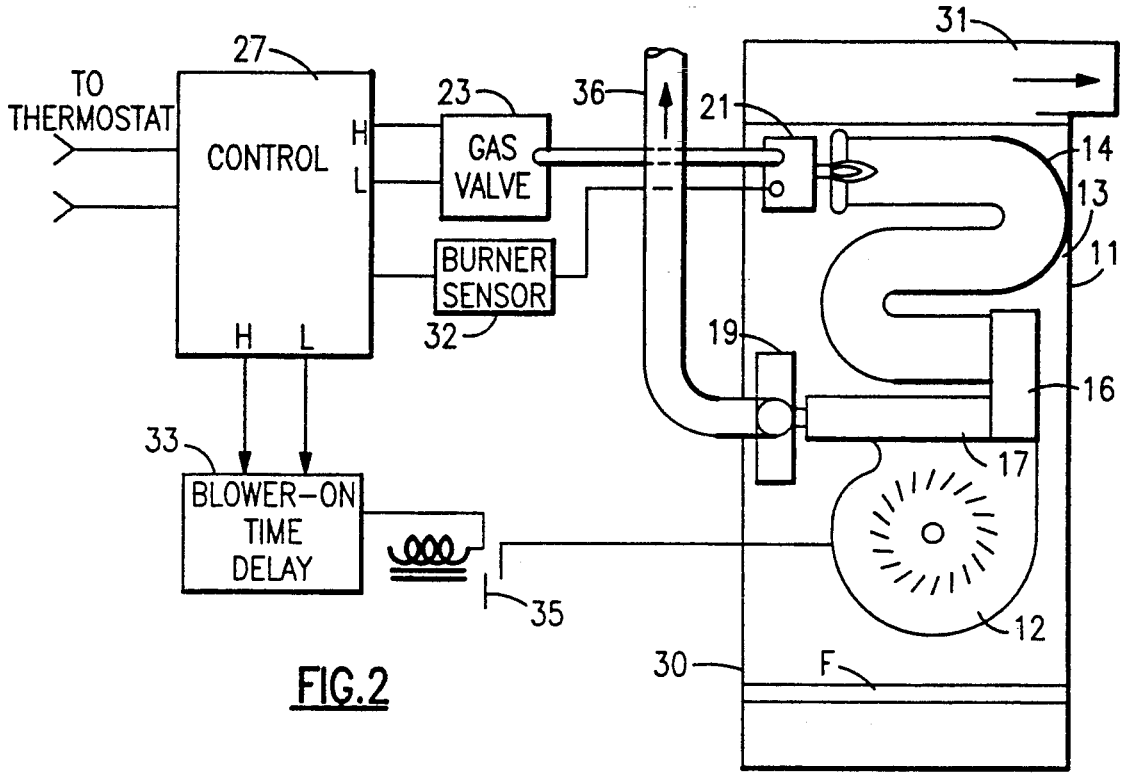
FIG. 2 is a schematic diagram for explaining the operation of this invention.

Shown schematically in FIG. 2 are the furnace 10 with its control circuitry. Here elements shown in FIG. 1 are identified with the same reference characters, and their specific description need not be repeated.

A circulation air intake cold air or return air plenum 30 and a hot air plenum 31 are positioned below the blower 12 and above the heat exchanger 13, respectively. The control box 27 is shown here schematically with input leads that connect to the thermostat to receive thermostat power when there is a call for heat. The control box 27 also has conductors coupled to the gas valve 23 to supply same with appropriate signals when there is a call for high heat or low heat, respectively. In response to those signals the gas valve supplies full gas flow or partial gas flow to the burners. A burner sensor 32 signals the control box 27 to prove burner ignition. If the burners fail to ignite after a predetermined time, then the control box circuitry can initiate a shut down and restart procedure. If ignition is proven, the control box signals a blower-on time delay circuit 33 with a signal H or L to indicate a call for high heat or a call for low heat. After a suitable delay period, the time delay 34 actuates a relay 35 to supply power to energize the blower 12.

Here also a vent pipe 36 is shown connected to the inducer 19 to conduct the combustion products out to the exterior environment.

In this case, the delay circuit 33 imposes a shorter time delay period for high-fire and a longer time delay period for high fire.

Figure 3:
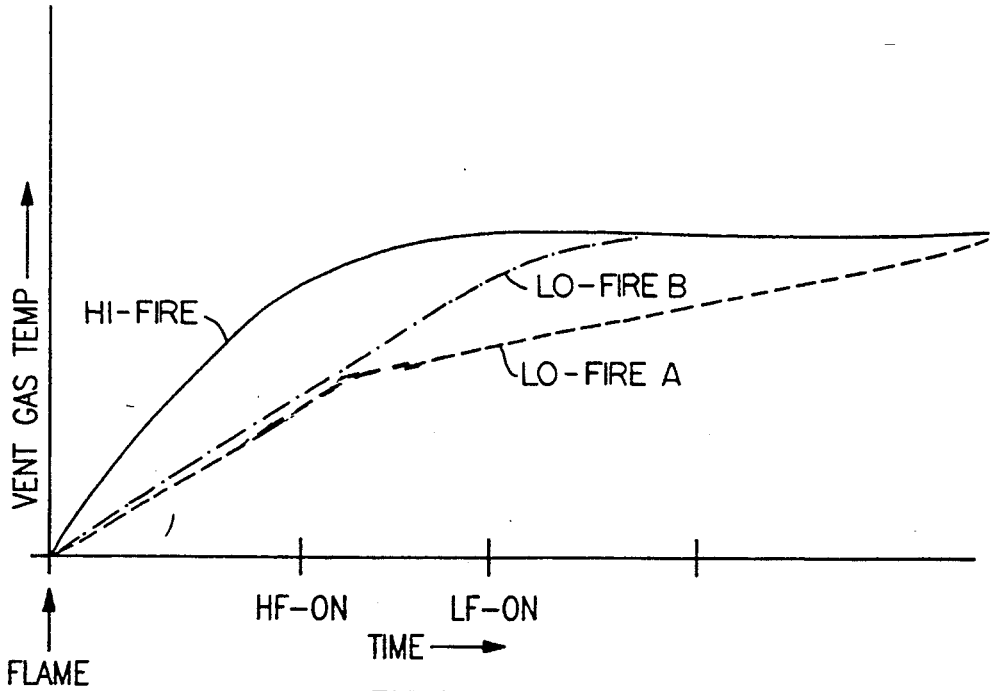
FIG. 3 is a chart showing vent gas temperature rise at start up under high fire and low fire conditions.

As shown in the chart of FIG. 3, under normal high fire operation, when the burners come on, the blower 12 is held off until a high-fire on time, about sixty seconds after ignition in this example. The vent gas temperature rises rapidly towards an equilibrium condition, as shown in solid line.

As shown in broken line as Lo-Fire A, if the burners operate at low fire, and the delay circuit 33 actuates the blower 12 after the same high fire blower-on delay, the blower will come on before thermal equilibrium is reached in the vent gas. Then the temperature of the heat exchanger and vent will continue to rise but at much lower rate. This creates a greatly lengthened condensate dwell time in the heat exchanger and vent pipe.

Instead, in this invention the delay timer imposes a greater blower-on delay when there is a call for low heat. As shown in chain line as Low-Fire B, under these conditions the vent gas temperature continues to rise and reaches equilibrium much sooner than the previous example of Lo-Fire A.

The time delay periods in question are selected to permit the furnace to reach equilibrium conditions quickly under any corresponding burner speed. It is possible to apply the invention in principle to a multiple speed furnace in which the burners are actuable at three or more rates.

Some ignition systems prove ignition source rather than flame. For example, a thermocouple can prove the presence of a pilot flame, or a radiant sensor can prove than an igniter is hot.

The concept of this invention can apply to condensing and to non-condensing furnaces as well. In the case of a condensing furnace the concern is with condensate dwell on the primary heat exchanger. For a mid-efficiency furnace, the concern is with both the heat exchanger and the vent system.

While this invention has been described with reference to a preferred embodiment, it should be recognized that the invention is not limited to that precise embodiment. Rather, many modifications and variations would present themselves to those skilled in the art without departing from the scope and spirit of the invention, as defined in the appended claims.

What is claimed is:

1. In a furnace for supplying circulating heated air to an interior comfort space and in which at least one burner sends heated combustion products through a heat exchanger which are exhausted therefrom through an exhaust vent to an outside environment, the burner being actuable into a high-fire full heat mode, a low-fire partial heat mode, and shut off; a circulation blower is operative to force return air drawn from said comfort space through said heat exchanger to absorb heat from said combustion products, from where the air is returned as heated circulation air to said comfort space; controller means responsive to a thermostat in said comfort space and operative to select a call for low heat or a call for high heat depending on heating conditions in said comfort space, including means for actuating said at least one burner at said high-fire mode when there is a call for high heat and at said low-fire mode when there is a call for low heat, and for shutting off said at least one burner when said thermostat is satisfied; and blower delay timer means for delaying energization of said circulation blower by a first predetermined delay period after actuation of said at least one burner into said high-fire mode to permit the vent gases to heat up suitably before said blower forces said return air therethrough;

the improvement wherein said blower delay timer means is operative for delaying energization of said circulation blower by a second time delay period, longer than said first time delay period, after actuation of said at least one burner into said low-fire mode to permit said vent gases to heat up suitably under low heat operation before said blower forces said return air therethrough.

2. The improved furnace according to claim 1 wherein said at least one burner is supplied with a fuel gas, and said furnace includes a flame sensor that proves flame from said at least one burner to commence operation of said blower delay timer means.

3. The improved furnace according to claim 1 wherein said heat exchanger includes a primary heat exchanger stage receiving the combustion products from said at least one burner, and a secondary condensing heat exchanger stage following said primary heat exchanger stage, and wherein an inducer following said secondary stage induces flow of said combustion products through said heat exchanger.

* * * * *